United States Patent [19]

Hintermeier et al.

[11] Patent Number: 4,775,488

[45] Date of Patent: Oct. 4, 1988

[54] AQUEOUS ANIONIC DISPERSION

[75] Inventors: Karl Hintermeier, Frankfurt; Heinrich Bathelt, Altötting; Frank Wehowsky, Burgkirchen; Hans Wagener, Hofheim; Manfred Seidel, Frankfurt; Manfred Müller, Gelnhausen; Klaus Kaschub, Frankfurt, all of Fed. Rep. of Germany

[73] Assignee: Cassella Aktiengesellschaft, Frankfurt am Main, Fed. Rep. of Germany

[21] Appl. No.: 850,592

[22] Filed: Apr. 11, 1986

[30] Foreign Application Priority Data

Apr. 20, 1985 [DE] Fed. Rep. of Germany ..... 3514373

[51] Int. Cl.[4] ..... D06M 13/00

[52] U.S. Cl. ..... 252/8.6; 106/2; 8/115.54

[58] Field of Search ..... 252/8.6; 8/115.54; 524/839; 106/2

[56] References Cited

U.S. PATENT DOCUMENTS 3,171,861 3/1965 Albrecht ..... 568/842
3,993,380 11/1976 Dickson et al. ..... 252/8.6

FOREIGN PATENT DOCUMENTS 59-94621 10/1985 Japan .
2051091 1/1981 United Kingdom .

OTHER PUBLICATIONS

Textilbericht 10/85.

*Primary Examiner*—A. Lionel Clingman
*Assistant Examiner*—John F. McNally
*Attorney, Agent, or Firm*—Connolly & Hutz

[57] ABSTRACT

An agent effective for oleophobizing and hydrophobizing textiles is an aqueous anionic dispersion which comprises water and (A) 5 to 25% by weight of a reaction product which contains at least one bis-(2-fluoroalkyl-ethoxy-carbonylamino)-toluene of the formula

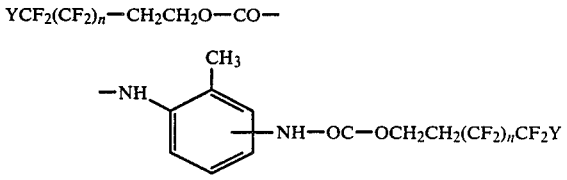

wherein n is a number from 5 to 15 and Y is —H or —F, and wherein said reaction product is prepared by reacting 2-perfluoroalkylethanol of the formula $$YCF_2-(CF_2)_n-CH_2CH_2OH$$

with tolylene diisocyanate in a molar ratio of (1.8 to 2):1 in the presence of 2 to 5% by weight of N-methylpyrrolidone, relative to the perfluoroalkylethanol, (B) 1 to 14% by weight of at least one emulsifier of the formula $$YCF_2(CF_2)_p-CH_2CH_2O-CO-NH-CH_2CH_2-SSO_3X$$

wherein p is a number from 5 to 15, Y is —H or —F, and X is a monovalent cation, (C) 1 to 14% by weight of at least one nonionic emulsifier of the formula $$YCF_2-(CF_2)_q-CH_2CH_2-(OCH_2CH_2)_r-OH$$

wherein Y is —H or —F, q is a number from 5 to 15, r is a number from 0 to 10, and (D) 5 to 30% by weight of a solvent or solvent mixture, with the proviso that the sum of the amounts of components (B) and (C) is 2 to 15%.

11 Claims, No Drawings

AQUEOUS ANIONIC DISPERSION

The present invention relates to an aqueous anionic dispersion which contains a bis-(2-perfluoroalkyl-ethoxy-carbonylamino)toluene, to its preparation and to its use for oleophobizing and hydrophobizing textiles, as well as to the active ingredient contained in the dispersion.

U.S. Pat. No. 3,171,861 discloses for example that 3-(perfluorooctyl)-propanol can be reacted with toluene diisocyanate to give the corresponding diurethane and that this compound, applied from a solution in an acetone/1,1,1-trichloroethane mixture to various textiles, imparts to the treated textiles an oil-repelling property.

Japanese Offenlegungsschrift No. 59-094,621 (as cited in Textilbericht 10/85) discloses that synthetic fibres can be given a soil-, water- and oil-repellent finish by applying before drawing, together with the spinning oil, a fluorine-containing compound, for example 2,4-bis(2-perfluoroalkyl-ethoxy-carbonylamino)toluene in such an amount that the applied film contains at least 20% by weight of fluorine.

A commercial product for finishing textiles contains such fluorine-containing bisurethanes together with cationic dispersants in an aqueous dispersion. The disadvantage with the use of this dispersion, however, is that fibres and textiles treated therewith attract soil particles which normally carry an anionic charge. For that reason the cationic dispersions of the fluorine-containing bisurethanes need to contain a special addition of anti-static agent, if one is to avoid the necessity of subsequently subjecting the finished goods to an additional anti-static finish.

For the stated reasons it is therefore desirable to apply the fluorine-containing bisurethanes to the textiles to be treated, in the form of an anionic, aqueous dispersion. However, to date it has not been possible to convert fluorine-containing bisurethanes into an aqueous anionic dispersion which meets the requirements of the industry, in particular that of having long-term stability at temperatures of −20° C. to +40° C.

It has now been found, surprisingly, that such aqueous anionic dispersions of fluorine-containing bisurethanes as meet the requirements of the industry can be prepared.

The aqueous anionic dispersion according to the invention contains:

(A) a% of a product which contains at least one bis-(2-fluoroalkyl-ethoxy-carbonylamino)-toluene of the formula I

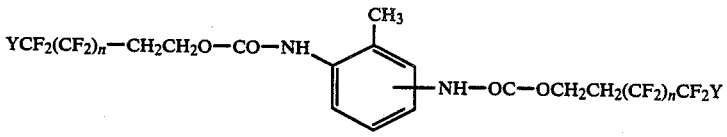

(I)

where n denotes a number from 5 to 15 and Y denotes —H or —F, which is preparable by reacting 2-perfluoroalkylethanol of the formula II $$YCF_2-(CF_2)_n-CH_2CH_2OH \quad (II)$$

where n and Y have the previously mentioned meanings, with tolylene diisocyanate in a molar ratio of (1.8 to 2):1 in the presence of 2 to 5% of N-methylpyrrolidone, relative to the compound of the formula II, (B) b% of at least one emulsifier of the formula III $$YCF_2(CF_2)_p-CH_2CH_2O-CO-NH-CH_2CH_2-SSO_3X \quad (III)$$

where p denotes a number from 5 to 15, Y denotes —H or —F and X denotes a monovalent cation, (C) c% of at least one nonionic emulsifier of the formula IV $$YCF_2-(CF_2)_q-CH_2CH_2-(OCH_2CH_2)_r-OH \quad (IV)$$

where Y denotes —H or —F, q denotes a number from 5 to 15, r denotes a number from 0 to 10 and (D) d% of a solvent or solvent mixture, a denoting a number from 5 to 25, b a number from 1 to 14, c a number from 1 to 14, d a number from 5 to 30 and the numerical values for b and c being chosen in such a way that the sum (b+c)=2 to 15.

The abovementioned percentages are by weight. The percentages for a, b, c and d are relative to the total weight of the aqueous dispersion. For the purposes of the present invention, the perfluoroalkyl radicals and compounds mentioned heretofore and hereinafter can according to the abovementioned definitions also have in the ω-position an H atom for Y. However, the genuine perfluoroalkyl radicals and compounds, i.e. those compounds of the formulae I to IV in which Y denotes —F, are preferable.

The compounds of the formulae II, III and IV can be used in the form of their technical mixtures which as a rule contain a plurality of compounds of the kind mentioned having different index numbers n, p, q and/or r.

Compounds of the formula I are known. However, the active substance A, which according to the invention is used for preparing the aqueous anionic dispersion, is new. To prepare the product specified in section A, a 2-perfluoroalkyl-ethanol of the formula I or a mixture of different 2-perfluoroalkyl-ethanols of the formula II are reacted with a tolylene diisocyanate or a mixture of different tolylene diisocyanates in a molar ratio of (1.8 to 2):1 in the presence of 2 to 5% by weight, preferably 2 to 3.5% by weight, relative to the compound of the formula II, of N-methylpyrrolidone. Highly suitable starting materials therein are technical mixtures of 2-perfluoroalkyl-ethanols of the formula II which contain compounds where n=5 to 11. Particularly suitable are compounds of the formula II where n=7 to 11, not only in the form of the individual compounds but also in the form of their technical mixtures.

The tolylene diisocyanate can be in particular 2,4- and/or 2,6-tolylene diisocyanate, in particular in the form of a commercial product which contains about 80% by weight of 2,4-tolylene diisocyanate and about 20% by weight of 2,6-tolylene diisocyanate.

The reaction to prepare product A is generally carried out by melting compound II or the mixture of compounds II and adding to the melt 2 to 5% by weight, preferably 2 to 3.5% by weight, of N-methylpyrrolidone and subsequently, at a temperature about 5° to 10° C. above the melting point, adding the tolylene diisocyanate or the mixture of tolylene diisocyanates dropwise with stirring. This is followed by heating to temperatures of about 130° C. in the course of one hour, during which the reaction is slightly exothermic from temperatures of about 80° C. Finally the reaction is brought to completion by about three hours of reaction at about 130°. The progress of the reaction is checked continuously by IR spectroscopy on sampled specimens for the disappearance of the isocyanate bands. If the reaction has not come fully to completion within the specified time, the reaction time needs to be extended, for example to six hours.

The addition of N-methylpyrrolidone presumably results in the formation of by-products of as yet unknown structure, which, as the product is dispersed according to the invention, act as excellent dispersion stabilizers. A larger addition of N-methylpyrrolidone in the preparation of product A has no adverse effect on the dispersion-stabilizing effect, but unnecessarily reduces the yield of active substance of the formula I.

The monovalent cation X in the compounds of the formula III generally represents an alkali metal cation, in particular the sodium or potassium cation, or the ammonium cation. The ammonium cation may also be substituted by organic radicals, may for example represent triethanolammonium. Compounds of the formula III are commercially available in particular in the form of their technical mixtures where p=5 to 11 or 7 to 11. Preferably the compounds of the formula III where p=7 to 11 are used in the form of the individual compounds or in the form of their technical mixtures.

The emulsifiers of the formula IV are likewise commercially obtainable, usually in the form of their technical mixtures. Therein r is in particular about 6. Preference is given to emulsifiers of the formula IV where q=5 to 11, in particular 7 to 11, and r=4 to 8, in the form of the individual compounds or in the form of their technical mixtures.

The numbers b and c each preferably denote 1 to 9, these numerical values being preferably chosen in such a way that the sum (b+c)=2 to 12. d preferably denotes a number from 10 to 25.

To prepare the aqueous anionic dispersions according to the invention, components A, B, C and D are dispersed in water using a comparatively large amount of energy. The mixing ratios for the components are chosen to be such that after the dispersing the specified composition for the dispersion is obtained. It is therein indispensible to predissolve product A in at least some of the solvent or solvent mixture which is to be used, and it is advantageous to split the dispersing into two parts and first to carry out a predispersal and then a fine dispersal. The predispersal is advantageously effected by application of high shear forces, for example by using a high-speed stirrer, such as, for example, in the case of a dispersing machine of the Ultraturrax type, and the resulting predispersion is then subjected for example to an ultrasonic treatment or to a treatment in a high-pressure homogenizer. After this treatment is complete, the particle size in the dispersion is over 80%, preferably over 95%, at or below 1 μm. Suitable as solvent component D are water-soluble solvents, such as, for example, mono- or di-alcohols, lower ketones, polyglycol esters and polyglycol ethers or mixtures of such solvents. Advantageously component D contains at least one high-boiling, water-soluble solvent, i.e. a solvent whose boiling point is above about 150° C. The solvent mixture used may also contain one or more water-insoluble solvents, such as, for example, esters, ethers and/or higher ketones. Low-boiling solvent portions may be removed again at a later date, for example by distillation.

Suitable water-soluble, high-boiling solvents are in particular the ($C_1$–$C_4$)monoalkyl and dialkyl ethers of di-ethylene glycol and/or dipropylene glycol. The stability of the dispersion is also favoured by addition of isopropanol, glycol or glycerol, individually or mixed, preferably in an amount of 1 to 5% by weight, relative to the final formulation.

Particularly advantageous effects, in particular with respect to soil-repelling action, are obtained when the dispersion according to the invention additionally contains at least one anionically dispersed (meth)acrylate ester polymer or copolymer in amounts of e% by weight, e denoting a number from 5 to 25 which is advantageously so chosen that the sum (a+e)=15 to 30. Such (meth)acrylate ester polymers and copolymers are advantageously added to the dispersions according to the invention in the form of a separately prepared aqueous anionic dispersion. It is also advantageous to disperse the polymer or copolymer dispersion using a compound of the formula III or a mixture of such compounds.

The (meth)acrylate ester polymers or copolymers normally contain building blocks of esters of acrylic and/or methacrylic acid with $C_1$- to $C_{18}$-alcohols and can be prepared, for example, in conventional manner. Methacrylic ester copolymers are preferred, in particular when the monomer mixture used for their preparation contains at least 80% by weight of esters of $C_1$- to $C_4$-alcohols. Particular preference is given to copolymers of methyl and isobutyl methacrylate, in particular when the methyl ester portion predominates in the copolymer. Very particular preference is given to a copolymer prepared from methyl methacrylate and isobutyl methacrylate in a weight ratio of 3:1. The preparation of this copolymer and its dispersal are described in Example 3. Other (meth)acrylic ester polymers and copolymers can be prepared and dispersed analogously.

The aqueous anionic dispersions according to the invention meet all the requirements of the industry and in particular have an excellent long-term stability at temperatures of −20° to +40° C. It is true that they freeze at minus temperatures, but the dispersion remains intact after thawing, unlike previously disclosed dispersions. The aqueous anionic dispersions according to the invention, when used in textile finishing, display an excellent oleophobizing, hydrophobizing, soil-repelling and conductivity-improving effect. They can be used for textile finishing not only alone but also in combination with other finishing agents, such as textile resins based on glyoxal or its derivatives, plasticizers, PVA and EVA or similar dispersions.

The aqueous anionic dispersions according to the invention are suitable for finishing textiles made of natural or synthetic fibres, in particular nylon, polyester, polyacrylonitrile and wool, or mixtures of these types of fibres. The textile material can be present in any desired form, thus for example as filament, fibre, yarn, flock, as woven, knitted or nonwoven fibre, or in particular as carpet.

The dispersions according to the invention can be applied to the textile material in the form in which they are obtained after the preparation. Normally, however, they are diluted before use with water to a solids content of 1 to 10% by weight, preferably 1.5 to 5% by weight. The application to the textile material to be treated can be effected in every suitable manner, thus for example by spraying, slop-padding, nip-padding etc. The amount applied is so chosen that 0.01 to 1% by weight of fluorine, preferably 0.05 to 0.2% by weight of fluorine, is present on the textile material. This corresponds approximately to an amount of 0.1 to 10, preferably 0.5 to 2, % by weight of solids content. Application to the textile material to be treated is followed by drying at temperatures up to about 120° C., for example at 100° to 120° C., and a subsequent heat treatment at temperatures of about 130° to 190° C., preferably 140° to 180° C., normally for about 4 min to about 30 sec.

There are signs that the high-boiling organic solvents preferably contained in the dispersion also have an important function in the fixing of the active substance of the formula I to the fibre in the sense of a kind of carrier effect.

In the examples below, percentages are by weight unless otherwise stated.

EXAMPLE 1

Preparation of Product A 1,080 g (=2 mol) of a commercially available mixture of 2-perfluoroalkyl-ethanols of the formula II in which individual products where n=7 to 11 are contained and Y denotes —F are heated up in a reaction vessel to above the melting point of 65° C., and 30 g of N-methylpyrrolidone are added. At a temperature of 70° to 75° C. 174.16 g (=1 mol) of a technical mixture of 80% 2,4 and 20% 2,6-tolylene diisocyanate are then added dropwise with stirring in the course of 30 min. The temperature is then raised to 130° C. in the course of 1 h, during which the reaction proceeds slightly exothermically from 80° C., and is maintained at 130° C. for about 3 h.

The progress of the reaction is monitored by IR spectroscopy on sampled specimens for the disappearance of the isocyanate bands. The reaction time is shortened or extended as may be necessary.

The result obtained is 1,184 g of a yellowish brown melt which on cooling down solidifies into a slightly brownish crystalline cake.

Melting point: 90° to 118° C.

Average F content: 59%.

EXAMPLE 2

(Comparative example)

Example 1 is repeated without the addition of N-methylpyrrolidone. The result obtained is 1,154 g of a slightly yellowish melt which on cooling down solidifies into a rigid, slightly yellowish crystalline cake.

Melting point: 116° to 120° C.

Average F content: 60.5%.

EXAMPLE 3

Preparation of a methacrylate ester copolymer

A 250 ml stock reservoir vessel equipped with stirrer and bottom outlet is charged with 75 g of methyl methacrylate and 25 g of isobutyl methacrylate, which are stirred until homogeneous, whereupon the stirrer is switched off.

A 500 ml polymerization flask equipped with stirrer, thermometer, gas inlet tube, reflux condenser, dropping funnel and inflow facility from the stock reservoir vessel is charged with 130 g of water, 30 g of a 25% strength isopropanol solution of a commercially available emulsifier of the formula V $$CF_3(CF_2)_5—CH_2CH_2O—CO—NH—CH_2CH_2—S-SO_3Na \quad (V)$$

and 22 ml of monomer solution from the stock reservoir vessel. While stirring and passing a slow stream of nitrogen into the solution, the polymerization flask is heated by means of an electrically heated water bath to 50° C. (55° C. bath). When this temperature is reached, 0.2 g of potassium persulfate is added in one portion. The polymerization reaction will begin immediately thereafter, as is to be noted by an increase in temperature up to about 57° C. and a change in colour (bluish and fluorescent). When the internal temperature exceeds 56° C., the dropwise addition of the monomer solution from the stock reservoir vessel and of a separately prepared catalyst solution comprising 0.2 g of sodium pyrosulphite ($Na_2S_2O_5$) and 10 g of water is started. At the same time the introduction of nitrogen can be discontinued. The addition of the monomer solution should be complete after about 1 h and that of the catalyst solution slightly later.

Throughout this entire dropwise addition the reaction temperature is 55° to 60° C. and the bath temperature an unchanged 55° C. When the dropwise addition is complete, the polymer emulsion is heated to 60° to 62° C. (65° C. bath temperature) and is stirred under these conditions for 1 h, is then cooled down to room temperature and is filtered through a PE sieve bag (105 μm). 270.4 g of an approximately 40% strength whitish, opaque dispersion are obtained.

EXAMPLE 4

Preparation of a methacrylate ester copolymer

Example 3 is repeated, except that the 30 g of the isopropanol solution of the emulsifier used there are replaced by 4 g of a commercially available alkanesulfonate used as a detergent base (for example commercial products ®Warolat U from Bayer AG).

244.2 g of an approximately 40% strength whitish, opaque dispersion are obtained.

EXAMPLE 5

Preparation of a dispersion according to the invention

In a 200 ml ground joint three-necked flask in beaker form, 12.1 g of product A prepared as in Example 1, 5 g of diethylene glycol dimethyl ether, 5 g of dipropylene glycol monomethyl ether and 3 g of perfluoroalkylethyl polyglycol of the formula VI $$CF_3(CF_2)_{7\text{-}11}—CH_2CH_2—(OCH_2CH_2)_6—OH \quad (VI)$$

are dissolved at 80° to 90° C. Thereafter 5 g of a 25% strength isopropanol solution of a compound of the formula VII $$CF_3(CF_2)_5—CH_2CH_2—O—CO—NH—CH_2CH_2—SSO_3Na \quad (VII)$$

are mixed in at 80° C.,

The solution has added to it at 80° C. dropwise using powerful shearring forces of a dispersing machine of the Ultra-turrax type the solution of 1.25 g of the compound of the formula VII in 48.75 ml of water in the course of 2 to 3 min, during which the temperature drops to 45° to 50° C. At this temperature dispersal is continued for a further 10 to 15 min. The result obtained at this early stage is an emulsion of attractive appearance, which, however, is not yet storable in this form and soon forms a sediment.

The crude dispersion obtained is then subjected to a final fine treatment, namely through exposure to sound waves from an ultrasonic machine (for example of the Sonifier type from Branson), until 90% of the particles have a size of 1 μm or below. This usually takes 10 to 15 min. At the same time the temperature is first maintained by water cooling at 40° to 45° C. and towards the end is reduced by cooling with ice-water to 20° to 30° C.

This fine dispersion thus obtained then has added to it 20 g of the approximately 40% strength, anionically dispersed methacrylic ester copolymer of Example 3. The entire formulation is then treated once more with ultrasound for about 2 min while cooling at 20° to 30° C. The result obtained is 100 g of a fine, milkily opaque dispersion having a fluorine content of 7% (relative to active substance), which is very highly storable even at temperatures of −20° C. and +40° C.

After 24 hours of cooling to −20° C., rethawing produced no visible changes in the dispersion.

EXAMPLE 6

(Comparative example)

Example 5 is repeated, except that the product A prepared in accordance with Example 1 is replaced by 11.8 g of the bisurethane prepared in Example 2.

The dispersion obtained is not storable, since a marked sediment has formed within as short a period as 24 h and continues to grow with time.

EXAMPLE 7

Preparation of a dispersion according to the invention

A 200 ml ground joint three-necked flask in beaker form is charged with a solution of 1.25 g of a compound of the formula VII $$CF_3(CF_2)_5—CH_2CH_2—O—CO—NH—CH_2CH_2—SSO_3Na \quad (VII)$$

in 48.75 ml of water and 20 g of the approximately 40% strength, anionically dispersed methacrylic ester copolymer of Example 4. This mixture has added to it with stirring from the powerful shearing action of a dispersing machine of the Ultraturrax type a hot solution at 80° C. of 12.1 g of product A, prepared in Example 1, in 5 g of diethylene glycol dimethyl ether, 5 g of dipropylene glycol monomethyl ether, 3 g of perfluoroalkylethyl polyglycol of the formula VI $$CF_3(CF_2)_{7\text{-}11}—CH_2CH_2—(OCH_2CH_2)_6—OH \quad (VI)$$

and 5 g of a 25% strength solution of the compound of the formula VII in isopropanol, while the temperature drops to about 35° C. The mixture is treated for about a further 10 min with the Ultra-turrax without cooling until the temperature has risen to 45° to 50° C.

The result is an emulsion of attractive appearance which, however, is not yet storable in this form and soon forms a sediment.

This crude dispersion is then subjected to a final fine treatment, namely through exposure to sound waves from an ultrasonic machine (for example of the Sonifier type from Branson), until 90% of the particles have an average size of 1 μm or below. This usually takes 10 to 15 min, during which the temperature is first maintained by water cooling at 40° to 45° C. and towards the end is reduced by cooling with ice-water to 20° to 30° C.

The result obtained is 100 g of a very fine, milkily opaque dispersion having a fluorine content of 7% (relative to active substance), which is highly storable even at temperatures of −20° C. and +40° C.

EXAMPLE 8

Stability comparison at −20° C.

100 g samples each of the dispersions of Example 5 and 7 and Comparative Example 6 and also for comparison 100 g of a cationically dispersed commercial product are cooled down to −20° C. in a refrigerator for 24 h. All samples freeze solid. After thawing, the samples of Examples 5 and 7 are still satisfactorily homogeneous and are as effective as before the freeze test. The dispersion of the comparison, cationically dispersed commercial product has by contrast completely broken down, and even the sample of Comparative Example 6 breaks down on thawing.

EXAMPLE 9

Use of a dispersion according to the invention

The dispersion according to the invention prepared in accordance with Example 5 or 7 is diluted with water to a solids content of 2 to 4% by weight. The liquor thus obtained is used as a dip for textile material to be treated in web form, which is then squeezed off on a pad-mangle. Repetition of this process promotes the penetration of the substrate and increases the effectiveness of the product according to the invention.

The textile substrate is dried in a drying range at temperatures up to 120° C. and is then stabilized in the same or similar range by heat treatment at temperatures of 150° to 180° C. for 3 min to 3 sec.

EXAMPLE 10

The dispersion prepared in Example 5 is diluted with water to a solids content of 3% and is sprayed onto a tufted nylon carpet. The carpet is then dried at 110° C. and is subsequently subjected to a heat treatment at 150° C. for 3 min.

The treated carpet is tested for oleophobization using the 3M/AATCC 18-1966 method, for hydrophobization/spray by the AATCC 22-1952 method and for dry soiling by the following method:

The carpet sample is placed in a cylindrical vessel which is 20 cm in length and 10 cm in diameter and can be sealed with a lid. Thereafter 200 g of steel balls of 3 mm in diameter and 20 g of sieved vacuum-cleaner dust are added, and the vessel is sealed and rolled on a rolling frame for 1 h. The sample is then removed, is cleaned with a vacuum cleaner and is assessed.

The tests gave the values listed in Table I below:

TABLE I

| | Oleophobization (1) | Hydrophobization (2) | Dry Soiling AE/soiled (3) | Dry Soiling AE/soiled shampooed (3) |
|---|---|---|---|---|
| F add-on relative to pile | | | | |
| 0.05% | 100 + 5 | 90/100 | 4 | 5 |
| 0.1% | 110 + 6 | 90/100 | 4–5 | 5 |
| 0.2% | 120 + 6 | 100 | 5 | 5 |
| Solids add-on | | | | |

TABLE I-continued

| | Oleophobization (1) | Hydrophobization (2) | Dry Soiling AE/soiled (3) | Dry Soiling AE/soiled shampooed (3) |
|---|---|---|---|---|
| rel. to pile | | | | |
| 0.5% | 100 + 6 | 90 | 4–5 | 5 |
| 1% | 110 + 6 | 90/100 | 4–5 | 5 |
| 2% | 110 + 6 | 90/100 | 4–5 | 5 |

Best possible test results: -
(1) Oleophobization: 140 + 8
(2) Hydrophobization: 100
(3) Dry soiling: 5

The experimental results obtained with a cationically dispersed commercial product are given in Table II:

TABLE II

| | Oleophobization (1) | Hydrophobization (2) | Dry Soiling AE/soiled (3) | Dry Soiling AE/soiled shampooed (3) |
|---|---|---|---|---|
| F add-on relative to pile | | | | |
| 0.05% | 110 + 6 | 70/80 | 2–3 | 4–5 |
| 0.1% | 110 + 6 | 80 | 2–3 | 4–5 |
| 0.2% | 110 + 6 | 80 | 3 | 4–5 |
| Solids add-on rel. to pile | | | | |
| 0.5% | 110 + 6 | 70 | 2–3 | 4–5 |
| 1% | 110 + 6 | 70 | 2–3 | 4–5 |
| 2% | 110 + 6 | 70/80 | 2–3 | 4–5 |

What is claimed is:

1. An aqueous anionic dispersion which comprises water and (A) 5 to 25% by weight of a reaction product which contains at least one bis-(2-fluoroalkyl-ethoxy-carbonylamino)toluene of the formula $YCF_2(CF_2)_n—CH_2CH_2O—CO—$

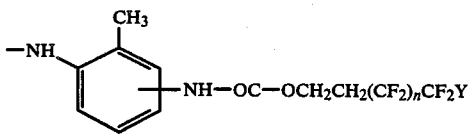

wherein n is a number from 5 to 15 and Y is —H or —F, and wherein said reaction product is prepared by reacting 2-perfluoroalkylethanol of the formula $YCF_2—(CF_2)_n—CH_2CH_2OH$ with tolylene diisocyanate in a molar ratio of 1.8:1 to 2:1 in the presence of 2 to 5% by weight f N-methylpyrrolidone, relative to the perfluoroalkylethanol, (B) 1 to 14% by weight of at least one emulsifier of the formula $YCF_2(CF_2)_p—CH_2CH_2O—CO—NH—CH_2CH_2—SSO_3X$ wherein p is a number from 5 to 15, Y is —H or —F, and X is a monovalent cation, (C) 1 to 14% by weight of at least one nonionic emulsifier of the formula $YCF_2—(CF_2)_q—CH_2CH_2—(OCH_2CH_2)_r—OH$ wherein Y is —H or —F, q is a number from 5 to 15, r is a number from 0 to 10, and (D) 5 to 30% by weight of a solvent or solvent mixture, with the proviso that the sum of the amounts of components (B) and (C) is 2 to 15%.

2. The aqueous anionic dispersion according to claim 1 wherein the amount of (B) is 1 to 9%, the amount of (C) is 1 to 9%, and the sum of (B) and (C) is 2 to 12%.

3. The aqueous anionic dispersion according to claim 2 wherein component (D) is 10 to 25%.

4. The aqueous anionic dispersion according to claim 1 wherein Y in each of components (A), (B) and (C) is —F, each of n, p and q are independently 5 to 11, and r is 4 to 8.

5. The aqueous anionic dispersion according to claim 4 wherein each of n, p and q are independently 7 to 11.

6. The aqueous anionic dispersion according to claim 1 wherein component (D) comprises at least one $C_1$–$C_4$-monoalkyl- or dialkyl ether of diethylene glycol or dipropylene glycol.

7. The aqueous anionic dispersion according to claim 1 wherein component (D) comprises 1 to 5% by weight of dispersion of isopropanol, glycol or glycerol.

8. The aqueous anionic dispersion according to claim 1 which additionally contains 5 to 25% by weight of component (E) which is at least one anionic dispersion of an ester polymer or copolymer of acrylic acid, methacrylic acid, or both.

9. The aqueous anionic dispersion according to claim 8 wherein component (E) is a copolymer of methyl methacrylate and isobutyl methacrylate.

10. The aqueous anionic dispersion according to claim 8 wherein the component (E) anionic dispersion of the (meth)acrylic ester polymer contains as emulsifier a compound of the formula $YCF_2(CF_2)_q—CH_2CH_2O—CO—NH—CH_2CH_2—SSO_3X$ wherein Y is —H or —F, q is 5 to 15 and X is a cation.

11. A process for preparing an aqueous anionic dispersion which comprises dissolving component (A) in an organic solvent or organic solvent mixture and dispersing therein compoennts (B) and (C) wherein (A) is a reaction product which contains at least one bis-(2-fluoroalkyl-ethoxy-carbonylamino)-toluene of the formula $YCF_2(CF_2)_n—CH_2CH_2O—CO—$

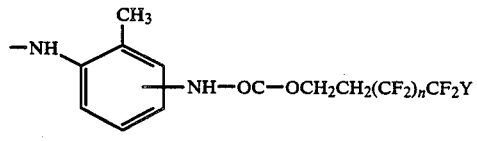

wherein n is a number from 5 to 15 and Y is —H or —F, and wherein said reaction product is prepared by reacting 2-perfluoroalkylethanol of the formula $YCF_2—(CF_2)_n—CH_2CH_2OH$ with tolylene diisocyanate in a molar ratio of (1.8 to 2):1 in the presence of 2 to 5% by weight of N-methyl-perfluoroalkylethanol, (B) is at least one emulsifier of the formula $YCF_2(CF_2)_p—CH_2CH_2O—CO—NH—CH_2CH_2—SSO_3X$ wherein p is a number from 5 to 15, Y is —H or —F and X is ia monovalent cation, and (C) is at least one nonionic emulsifier of the formula $YCF_2—(CF_2)_q—CH_2CH_2—(OCH_2CH_2)_r—OH$ wherein Y is —H or —F, q is a number from 5 to 15, r is a number from 0 to 10.

* * * * *